US010065723B2

(12) United States Patent
Baumberger

(10) Patent No.: US 10,065,723 B2
(45) Date of Patent: Sep. 4, 2018

(54) PROPULSION SYSTEM FOR A BOAT

(71) Applicant: Charles Baumberger, Provence (CH)

(72) Inventor: Charles Baumberger, Provence (CH)

( * ) Notice: Subject to any disclaimer, the term of this patent is extended or adjusted under 35 U.S.C. 154(b) by 0 days.

(21) Appl. No.: 15/563,168

(22) PCT Filed: Apr. 15, 2016

(86) PCT No.: PCT/EP2016/058423

§ 371 (c)(1),
(2) Date: Sep. 29, 2017

(87) PCT Pub. No.: WO2016/166331

PCT Pub. Date: Oct. 20, 2016

(65) Prior Publication Data

US 2018/0079477 A1 Mar. 22, 2018

(30) Foreign Application Priority Data

Apr. 15, 2015 (CH) ..... 00526/15

(51) Int. Cl.
*B63H 23/02* (2006.01)
*B63H 5/125* (2006.01)
*B63H 21/17* (2006.01)

(52) U.S. Cl.
CPC ..... *B63H 23/02* (2013.01); *B63H 5/125* (2013.01); *B63H 21/17* (2013.01); *B63B 2755/00* (2013.01); *B63H 2023/0233* (2013.01)

(58) Field of Classification Search
CPC .... B63H 5/125; B63H 5/1252; B63H 5/1254; B63H 5/1256; B63H 23/02;
(Continued)

(56) References Cited

U.S. PATENT DOCUMENTS 1,124,645 A * 1/1915 Overton ..... B63H 5/125 440/54
1,774,956 A * 9/1930 Wilson ..... B63B 17/0018 440/58
(Continued)

FOREIGN PATENT DOCUMENTS

EP 0529564 A1 3/1993
FR 2741854 A1 6/1997
(Continued)

OTHER PUBLICATIONS

International Search Report and Written Opinion for PCT/EP2016/058423 dated Jun. 15, 2016, 11 pages.

*Primary Examiner* — Ajay Vasudeva
(74) *Attorney, Agent, or Firm* — Abel Law Group, LLP

(57) ABSTRACT

A propulsion system for a boat includes a motor, a connecting arm, a fairing portion intended for being mounted on the boat, at least one propeller, a belt for transmitting the torque from the motor to the at least one propeller, the belt forming two belt sections between the motor and the propeller. The propulsion system further includes a first rotary assembly with the belt passing therethrough and capable of pivoting relative to the fairing portion about a geometrical axis directed towards the top, so as to orient the at least one propeller relative to the boat in order to turn the latter, and a second assembly capable of being translated relative to the first rotary assembly in order to retract the at least one propeller.

15 Claims, 16 Drawing Sheets

(58) Field of Classification Search
CPC .... B63H 2023/0208; B63H 2023/0216; B63H 2023/0225; B63H 2023/0233; B63H 2023/0241; B63H 2023/025; B63H 20/14; B63H 2020/145; B63H 20/32; B63H 21/17; B63B 2755/00
USPC ..... 440/54
See application file for complete search history.

(56) References Cited

U.S. PATENT DOCUMENTS 2,156,938 A * 5/1939 Edwards ..... B63H 5/125 440/54
2,302,795 A * 11/1942 Noble ..... B63H 25/42 440/54
2,722,193 A 11/1955 Brindley
3,483,843 A * 12/1969 Hawthorne ..... B63B 17/0018 440/54
3,707,939 A * 1/1973 Berg ..... B63H 5/125 440/58
3,795,219 A * 3/1974 Peterson ..... B63H 25/42 440/58
3,807,347 A * 4/1974 Baldwin ..... B63H 5/20 440/54
5,336,119 A * 8/1994 Lais ..... B63H 20/14 440/6
5,435,763 A 7/1995 Pignata
5,522,744 A 6/1996 Schlogel
7,530,319 B1 5/2009 Ha
2011/0111654 A1 5/2011 Porta

FOREIGN PATENT DOCUMENTS

GB 1240551 A 7/1971
WO WO9420362 A1 9/1994
WO WO2010063979 A1 6/2010
WO WO2013164175 A1 11/2013

* cited by examiner

PROPULSION SYSTEM FOR A BOAT

TECHNICAL FIELD

This disclosure relates to a propulsion system for a boat, in particular a propulsion system equipped with a retractable and orientable propeller, as well as a boat equipped with such a propulsion system.

STATE OF THE ART

Numerous propulsion systems for boats are equipped with a motor with a first shaft, with a propeller with a second shaft, and with a transmission element between these two shafts.

For example, in the documents EP0529564, WO10063979, GB1240551, U.S. Pat. No. 5,435,763 and WO9420362, the transmission between the motor and the shaft of the propeller is achieved by means of a belt. The belt is streamlined, but this streamlining causes great resistance having as a consequence a loss in hydrodynamism mainly at high speed.

Furthermore several solutions are likewise disclosed in the prior art proposing propulsion systems equipped with a retractable and orientable propeller. For example, the documents WO13164175, U.S. Pat. No. 5,522,744, FR2741854. However the mechanisms disclosed in these documents are complex.

BRIEF SUMMARY OF THE DISCLOSURE

One object of the present disclosure is to propose a propulsion system free of the limitations of the known documents.

Another object of the present disclosure is to propose a more hydrodynamic propulsion system.

Another object of the present disclosure is to have a simple, original, quiet and inexpensive system.

Lastly, another object of the present disclosure is to offer a propulsion system with a retractable and orientable function, in a reduced size, and employable in all the different configurations commonly used on boats.

According to the disclosure, these objects are attained in particular by a propulsion system for a boat comprising:

a motor;

a connecting arm;

a fairing portion intended for being mounted on the boat;

at least one propeller; and a belt for transmitting the torque from the said motor to the said at least one propeller, the said belt forming two belt sections between the said motor and the said propeller;

and further comprising:

a first rotary assembly with the belt passing there-through and capable of pivoting relative to the first fairing portion about a geometrical axis directed towards the top, so as to orient the said at least one propeller relative to the boat in order to turn the latter; and a second assembly capable of being translated relative to the first rotary assembly in order to retract the said at least one propeller.

Thanks to such a propulsion system, the limitations mentioned in the existing solutions can be overcome and it is in particular possible to obtain a propulsion system with a belt transmission, having moreover a function of retraction and orientation of the propeller, and this in a reduced size. These advantages are in particular obtained thanks to the use of a fixed fairing, on the interior of which two motorized mechanisms are positioned making it possible to retract the arm (and the propeller) and drive the latter in rotation in order to orient the propeller.

In a variant, the connecting arm comprises two sections set apart from each other, a single belt section passing through each section. The belt can be a closed loop belt. The term "belt section" designates each of the two portions of this belt between a pulley on the shaft of the propeller and a pulley on the shaft of the motor. By protecting each belt section by an independent section, the frontal surface of the connecting arm is reduced and water is allowed to pass between the two streamlined belt sections. This feature allows the hydrodynamism to be improved.

The connecting arm of the propulsion system can be non-impervious. The water can thus enter the connecting arm, be driven by the belt, and used for the cooling of the propulsion system.

The propeller (or each propeller) can be accommodated in a bulbous part and each propeller can be mounted on a turning shaft. Each propeller can also be mounted in a removable way on the turning shaft. This allows easy replacement of the propeller, without disassembling the bulbous part or the arm.

In one embodiment, the first rotary assembly is intended to be pivoted manually.

According to another variant, the propulsion system comprises a first electric motor for pivoting the first rotary assembly.

The propulsion system can comprise two belts in opposition, fixed at their ends to the fairing portion and put under traction by the said first electric motor for turning the first rotary assembly in order to orient the propeller with respect to the boat.

In a variant, the second assembly able to be translated with respect to the first rotary assembly in order to retract the propeller is intended to be translated manually.

In another variant, the propulsion system comprises a second electric motor to make the second assembly translate.

In addition, the present disclosure likewise relates to a boat comprising a propulsion system.

BRIEF DESCRIPTION OF THE FIGURES

Examples for implementing the device of the present disclosure are indicated in the detailed description illustrated by the attached figures in which:

FIG. 10 is a side view of a propulsion system according to FIG. 8.

DETAILED DESCRIPTION

Figure 1:
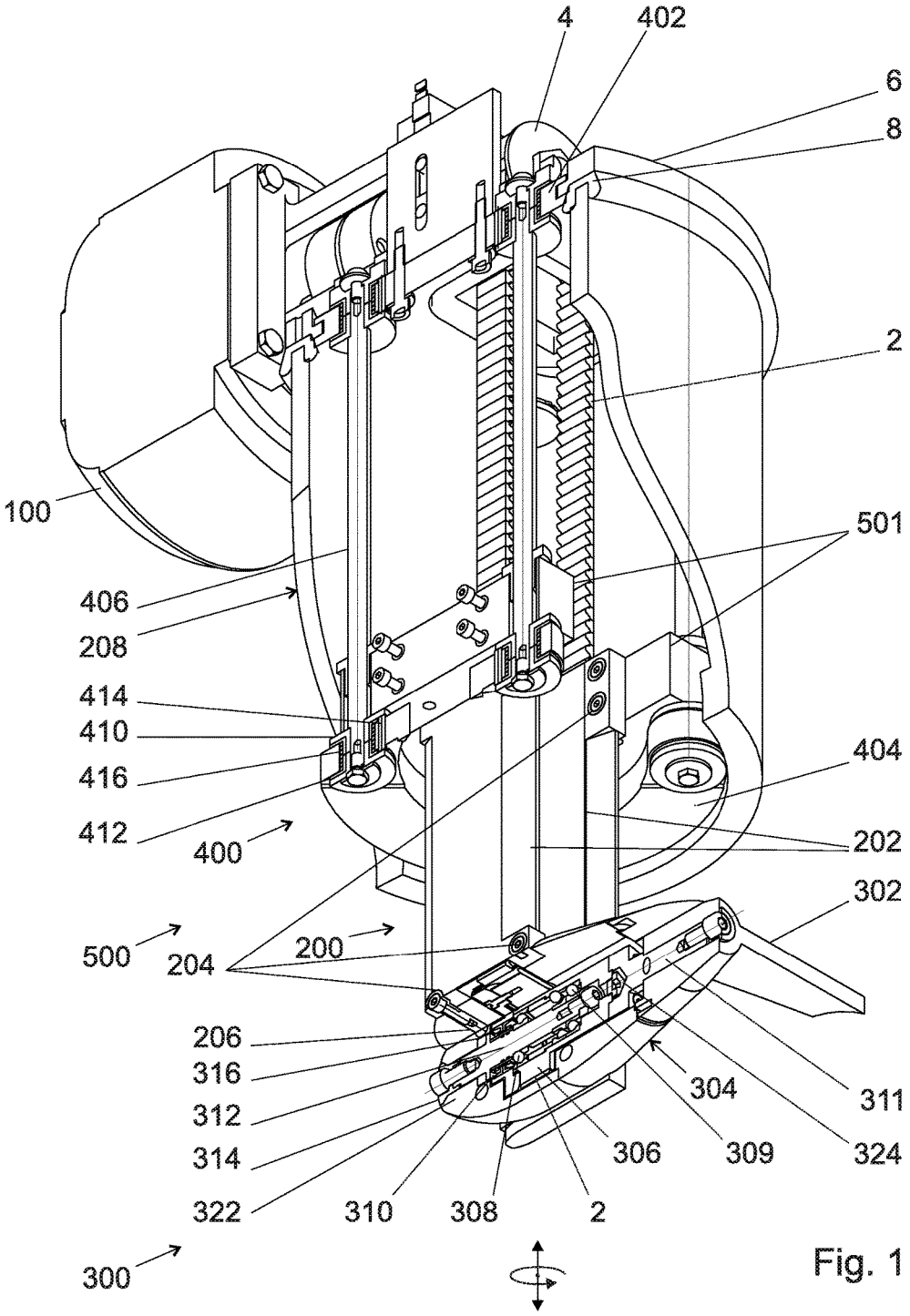
FIG. 1 is a view of a propulsion system according to a first example of the present disclosure in partial section along a vertical plane.

The propulsion system illustrated in FIG. 1 comprises in particular a motor 100, a connecting arm 200, a propeller 302 and a belt 2. The motor 100 can be an electric or hydraulic motor. It provides the energy necessary to move the boat forward. This energy is transmitted to the propeller 302 by means of the belt 2. The motor can also function as a generator for charging a battery of the boat in the case of a sailboat moving forward under sail.

In the present document, the term "belt" designates smooth or notched belts or equivalent elements, for example chains.

The belt 2 can be notched or smooth. This belt 2 forms two belt sections between the motor 100 and the propeller 302.

Figure 2A:
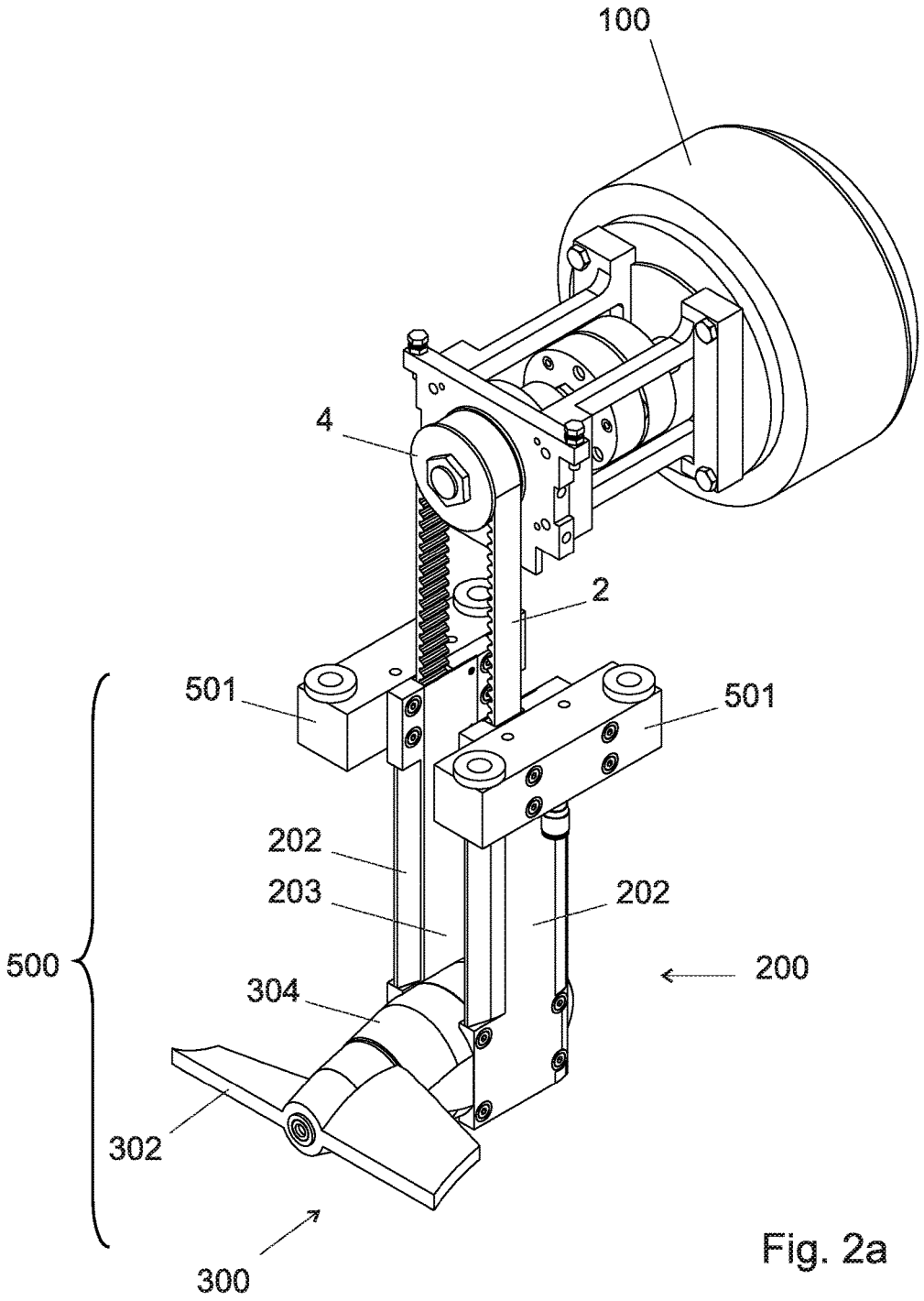
FIG. 2*a* is a partial representation in perspective of the propulsion system of FIG. 1 without fairing portion.

The connecting arm 200 is non-impervious and comprises two hollow sections 202 with an outer end section favoring its passage in the water, better visible in FIG. 2*a*. A single belt section of the belt passes into each section 202. The belt thus receives the energy through a pulley on the shaft of the motor 100, traverses a first section 202, transmits its energy to the pulley, then returns toward the shaft of the motor by way of the second section 202.

The two sections 202 have a hydrodynamic profile of fins. They are kept spaced apart and can be parallel to one another or not. Two covers 203 allow the two hollow sections 202 to be closed and streamlined once the belt has been introduced. These sections can be made of a composite material, and are fixed on the movable carriages 501 above, and to the bulbous part 300 below of the propeller 302, as will be seen. The mounting can be achieved by means of first conical inserts 204 which permit a quality of blockage, without play and without risk of loosening, independently of the stability of the geometric dimensions of the material used. The blockage by screw of these conical inserts 204, placed in opposition or not, is achieved through the agency of a first brace 206 adjusted on the length according to the geometry of the mounted elements.

In the variant illustrated in FIG. 2*a*, the belt is driven by a single pulley 4 and the two sections are connected to a single propeller 302. In this case the distance between the two sections 202 is given by the diameter of the pulley 4 which can range between 40 mm and 800 mm.

A large pulley diameter allows the belt to transmit a great driving torque with a significant duration of life. They allow moreover the two fins to be kept sufficiently spaced apart to give a great rigidity to the connecting arm.

Figure 2B:
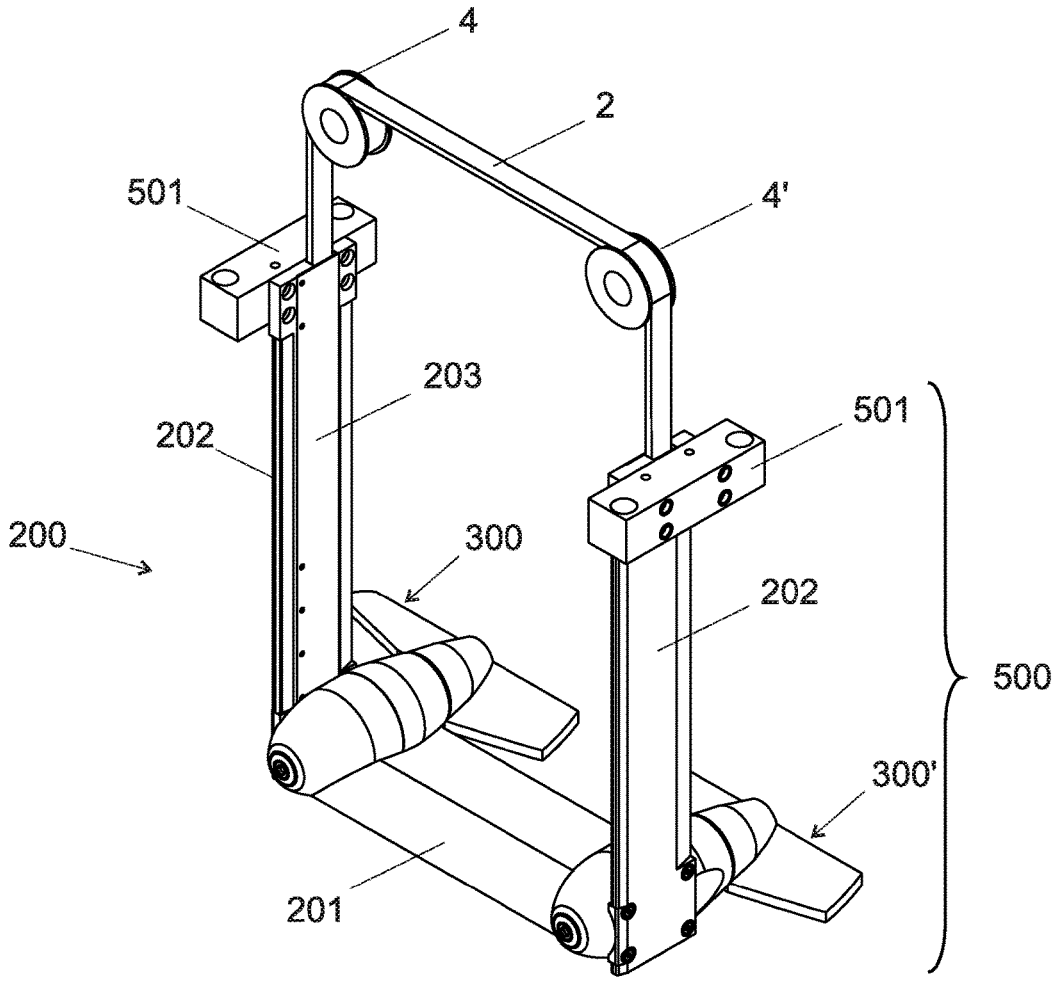
FIG. 2*b* is a partial representation in perspective of a second embodiment of the propulsion system of FIG. 1.

In another variant illustrated in FIG. 2*b*, the belt is driven by two pulleys 4, 4'. The propulsion system comprises two propellers 302, 302', each propeller being mounted in a bulbous part. The two bulbous parts are connected to one another by a foil 201 in the shape of a wing of an airplane. The belt 2 traverses the first section 202, drives the first propeller in the bulbous part, traverses the foil 201, drives the second propeller in the second bulbous part, then returns toward the motor by way of the second section 202. In this variant the distance between the two sections is given by the radius of the pulleys plus the spacing between the pulleys.

The bulbous part 300 of the propeller 302 comprises a notched pulley 306 driven by the belt 2 inside the bulbous part, a turning shaft 311 and a fixed shaft 312. This notched pulley 306 turns about the fixed shaft 312 by means of a ball bearing 308 for absorbing the radial forces and oblique bearings 309 for absorbing the radial and axial forces. The tightness seals 310 protect the bearings.

In a variant, the shaft of the pulley can also be mounted with two deep groove ball bearings, roller bearings, needle bearings, a thrust ball bearing or a thrust needle, tapered roller bearings or any other type of bearing permitting the radial and axial forces to be absorbed.

The notched pulley 306 is thus in rotation about the fixed shaft 312 which is retained in the nose of the bulbous part 322 and blocked in the front by a second conical insert 314 and a second brace 316.

The propeller is mounted on the turning shaft 311, whose rotation is driven by the pulley 306 thus permitting the rotation of the propeller.

The flank 304 connects geometrically the outer diameter of the nose of the bulbous part 322 with the outer diameter of the propeller. The shape of the bulbous part 300 favors the passage in the water, which allows the boat to gain in hydrodynamism. The emptying of the oil in the bulbous part takes place by opening an internal and threaded plug 324 in the bulbous part.

The belt 2 drives with it the water which is compressed with the passing of the pulley 306. This water is recovered for the cooling of the motor 100.

We are now going to describe the upper part of the propulsion system, and in particular the system allowing the propeller to pivot to orient the boat.

Figure 3:
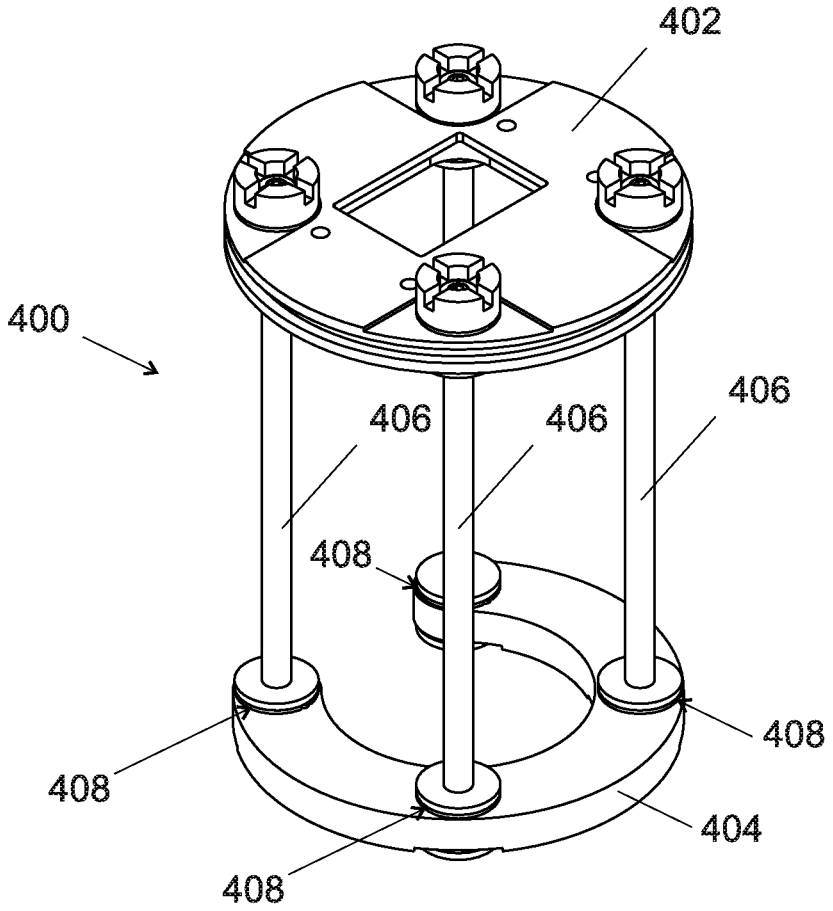
FIG. 3 is a perspective view of the first rotary assembly.

The propulsion system is connected to the boat by the fairing portion 208 fixed with respect to the hull of the boat. A first rotary assembly 400, visible in particular in FIG. 3, can turn manually or in a motorized way with respect to the first fairing portion 208 about an upward geometrical axis, in such a way as to orient the propeller with respect to the boat to make it turn.

The fairing portion 208 comprises a rigid open and preferably cylindrical covering with a round, square or any other cross section.

In the example illustrated, the first rotary assembly 400 comprises a cage formed by an upper flange 402 on which the motor 100 is mounted with the bearing of the pulley 4 and a lower flange 404 connected to the upper flange 402 by the rotary and preferably threaded rods 406. The flanges can be metallic or of polymer material. The motor 100 thus turns with the first assembly 400.

Figure 7:
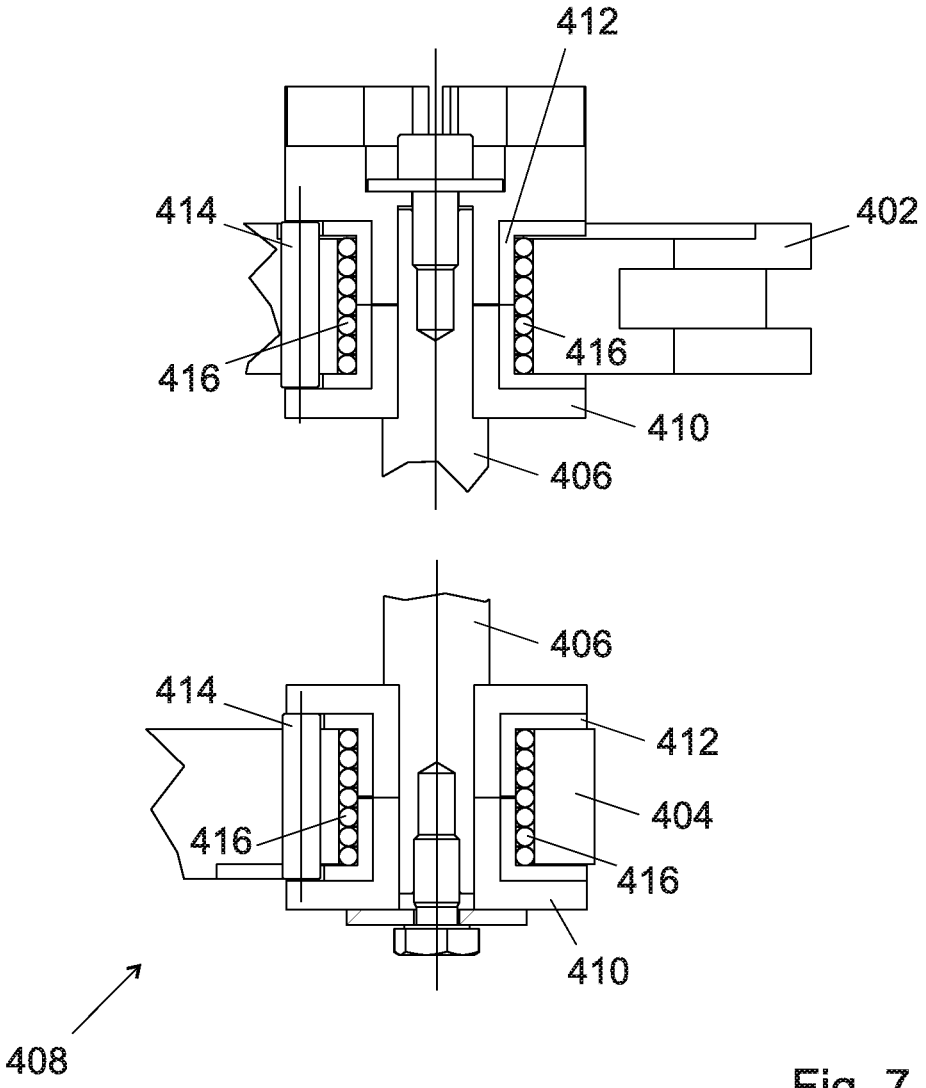
FIG. 7 is a sectional view of the inserts allowing the mounting of the rods on the flanges of the rotary assembly.

The rods 406 are fixed to the flanges 402, 404 by means of semi-rigid inserts 408 visible in FIG. 7. The inserts 408 are achieved with two collared bushings 410 mounted in opposition on each flange and blocked on a bearing surface at the ends of the threaded rods 406. To allow the rotation of the threaded rods, each bushing is provided with a self-lubricating pad 412, blocked in rotation by a fixed pin 414 fixed to the respective flange. The accommodation of the insert in the flange is dimensioned to allow the mounting of a flexible polymer element 416 or O-rings.

These inserts 408 allow the rods to pivot on themselves with respect to the flanges, and to compensate the possible flaws in parallelism of the rods 406.

Returning to FIG. 1, the weight of the mechanical assembly is supported by the upper flange 402 and transmitted to the fairing portion 208 by the bearing 6 which allows the rotary assembly 400 to turn. A brace in elastomer 8 absorbs the vibrations of the motor thus making it possible to prevent their being transmitted to the hull of the boat and thereby to reduce the noise. The upper flange 402 and the lower flange 404 connected to one another by the rods 406 absorb the torque created by the thrust of the propeller 302 and the tension force of the notched belt 2.

The first rotary assembly can be pivoted with respect to the fairing portion. The sections 202 being integral in rotation of the rods 406, this rotation is transmitted to the sections and thus to the bulbous parts 300 and to the propellers 302.

Figure 4A:
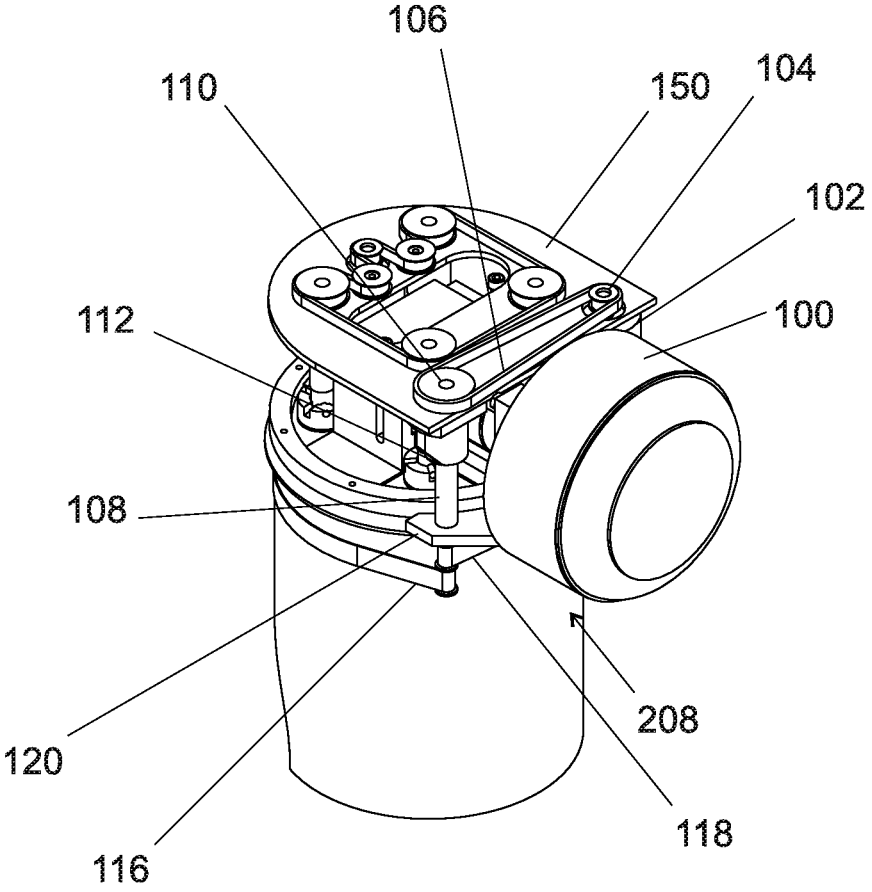
FIG. 4*a* is a perspective view of the upper part of the propulsion system of FIG. 1, illustrating in particular the system of orientation of the propeller.

In an embodiment not illustrated, the first rotary assembly 400 can be pivoted manually with respect to the fairing portion. In the preferred embodiment illustrated, an electric motor 102, visible in particular in FIG. 4*a*, is provided for this purpose. This motor drives a vertical axis pulley 104, which in turn drives, through the agency of a belt 106, the orientation shaft 108 equipped with a driven pulley 110 and a ball bearing arrangement 112.

Two flat belts 116 and 118 are fixed at one of their ends on the fairing portion 208 and at the other end on a bearing surface of the orientation shaft 108, in such a way that the first flat belt 116 unrolls and the second belt 118 is wound when the motor turns in a first direction, and vice-versa when the motor turns in the other direction. The traction exerted on the belt 116, respectively 118, causes the rotation of the rotary assembly 400. A mounted support 120 of a bearing makes it possible to ensure the rigidity of the winding shaft.

In a variant, the motor 102 can be controlled by a GPS navigation system or a driving assistance system.

Although we have just described the first assembly 400 permitting orientation of the propeller with respect to the boat in order to make it turn, this first rotary assembly 400 can also be blocked on the fairing portion in such a way that the propeller is not able to be oriented.

We are now going to describe the system permitting the propeller to be retracted in order to pull it up or lower it.

Figure 4B:
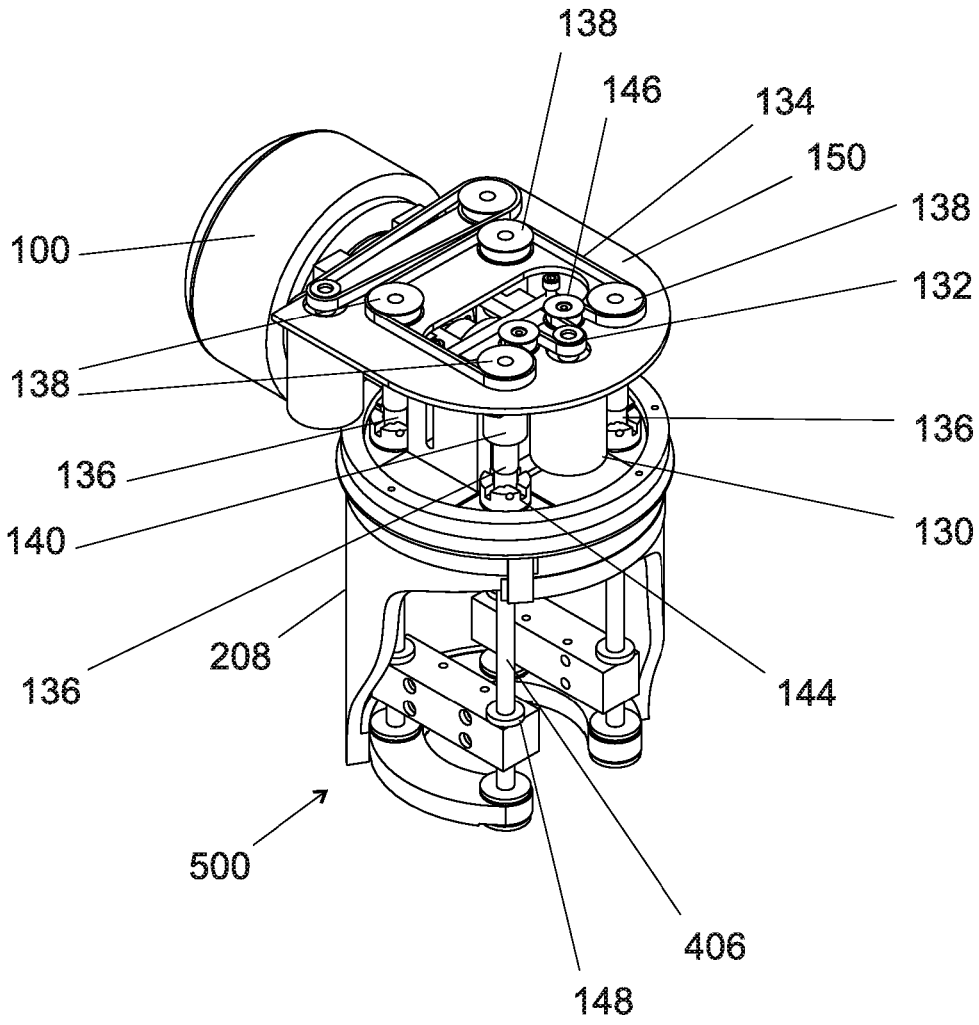
FIG. 4*b* is a perspective view of the upper part of the propulsion system of FIG. 1, illustrating in particular the system of retraction of the propeller.

To this end, the propulsion system comprises a second assembly 500 able to be translated with respect to the first assembly 400 and with respect to the first fairing portion 208 in order to retract the propeller 302. This system thus makes it possible to move the propeller between a retracted position inside the boat and an extended working position outside the boat. Details of this second assembly are visible in particular in FIG. 4*b*.

The second assembly 500 can be retracted manually; in this case the rods 406 can be smooth and non-rotary. In the preferred example illustrated, the second assembly 500 can be retracted in a motorized way thanks to the second motor 130 with transmission. This motor 130 is fixed to a support plate 150 and drives a pulley 132, which in turn drives the belt 134 driving four notched pulleys 138. The four pulleys 138 are each mounted on a driving shaft 136 equipped with a bearing with ball bearings 140. With engagement of the motor 130, these four driving shafts 136 drive the four threaded rods 406 in rotation through the agency of a drive collar 144, which four threaded rods 406 spin. The two carriages 501 mounted two at a time on the rods 406 through threaded nuts 148 thus ascend or descend along these rods, in the direction of rotation. As has been seen, each section 202 is mounted on one of the carriages 501, so that these sections and the bulbous part which is connected to them follow the vertical movements of the carriages. The elements are dimensioned in such a way that the belt 2 for driving the propeller is perfectly taut when the carriages are at the bottom, each belt section winding up on itself between the connecting arm and the fairing portion when the propeller is retracted.

Thanks to the inserts 408 which hold the rods 406 in a semi-rigid way, the rods drive the carriages 501 without risk of blockage. The loose pulleys 146 make it possible to tension the belt.

Although we have just described the second assembly 500 permitting the propeller to be retracted, this second assembly can also be blocked on the first assembly in such a way as not to retract the propeller.

Figure 5A:
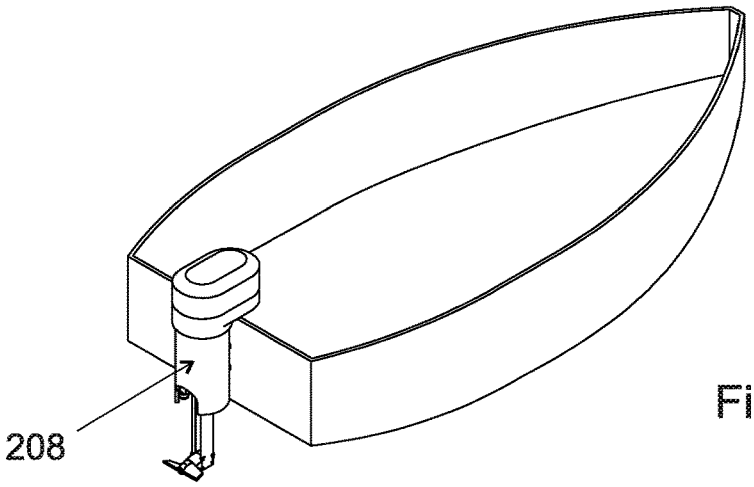
FIGS. 5*a* to 5*c* illustrate a boat equipped with the propulsion system according to three different embodiments.
Figure 5B:
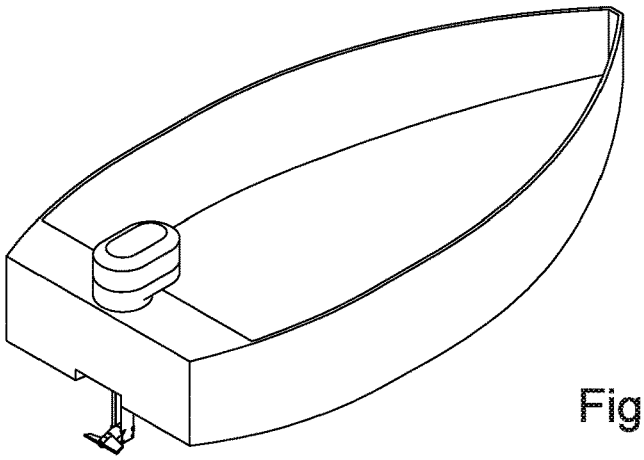
Figure 5C:
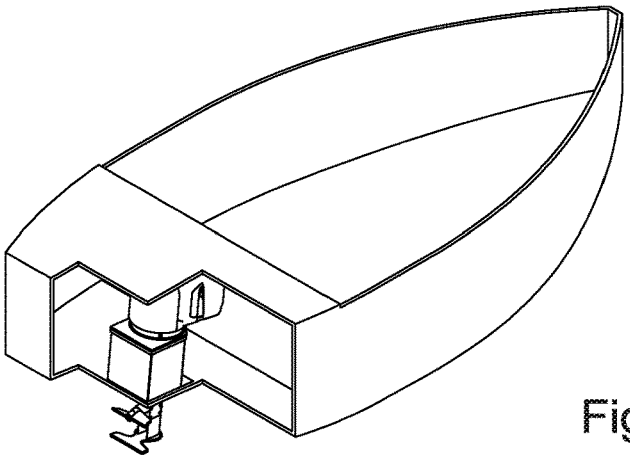
Figure 6:
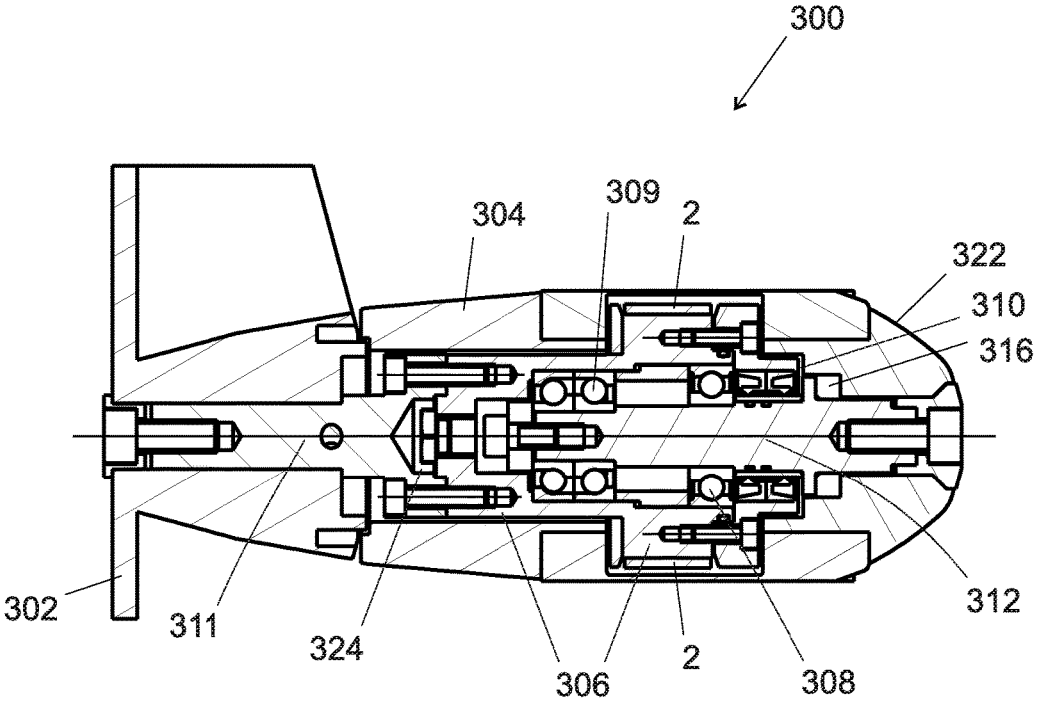
FIG. 6 is a view in longitudinal section of the bulbous part of the propeller.

According to a third embodiment, the propulsion system can be mounted in the boat in an inboard way as FIG. 5*a* illustrates. According to another embodiment, the propulsion system can be mounted in an outboard way as illustrated in FIG. 5*b*. In another embodiment, the propulsion system can be integrated directly in the rear board of the boat as illustrated in FIG. 5*c*.

Another embodiment example of the present disclosure is represented in FIGS. 8 to 15.

The propulsion system according to this second embodiment example does not differ in a fundamental way from the propulsion system according to the first embodiment example, described in FIGS. 1 to 7. However, this second embodiment example also comprises some new elements with special advantages.

Figure 8:
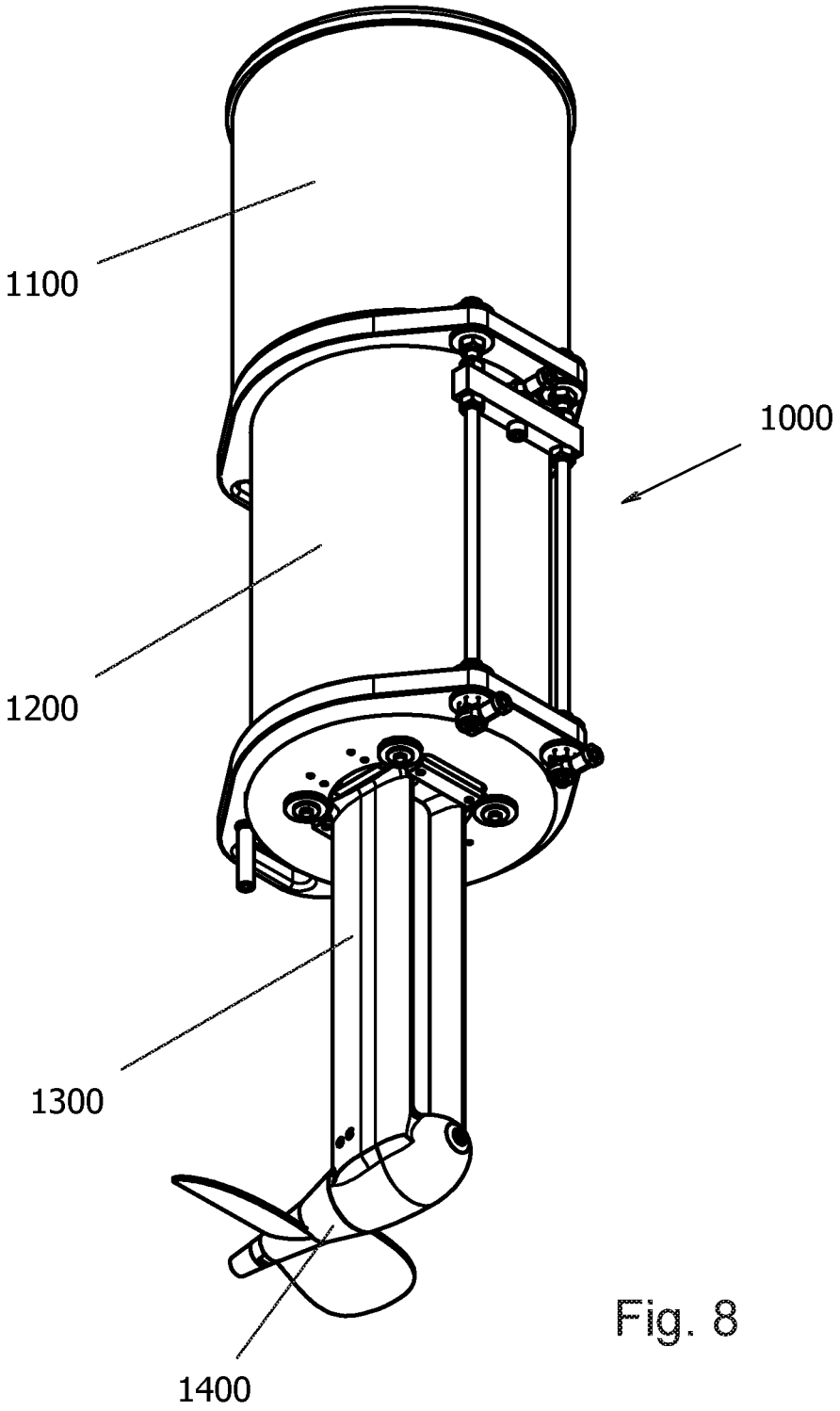
FIG. 8 is a perspective view of a propulsion system according to a second example of the present disclosure, in particular an outboard propulsion system.
Figure 9:
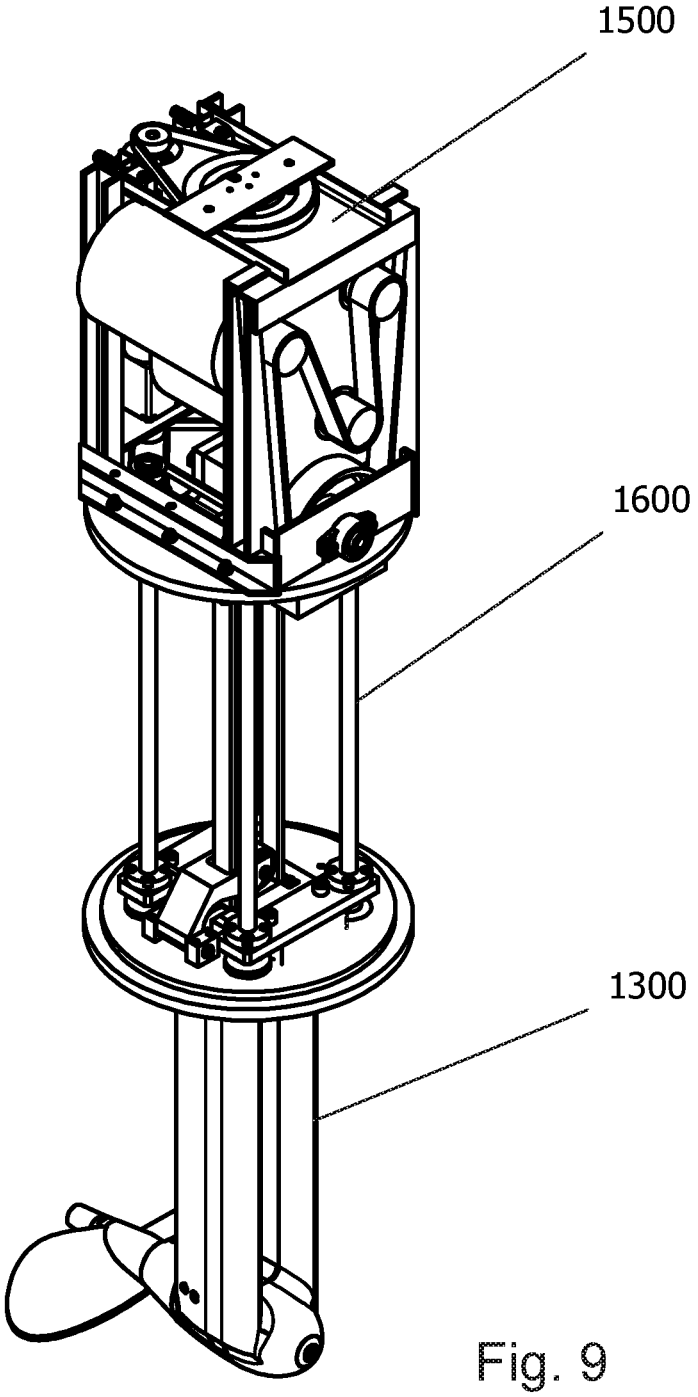
FIG. 9 is a perspective view of a propulsion system according to FIG. 8, without the fairing and without the casing encompassing the motorization assembly.

The propulsion system according to this second embodiment example, generally designated 1000 illustrated in FIGS. 8 and 9 also comprises a motorization assembly 1500 inside a casing 1100, a fairing 1200 encompassing the assembly 1600 making it possible to achieve the functions of retraction and orientation of the propeller, a connecting arm 1300 and a bulbous part of the propeller 1400. This motorization assembly 1500 (represented in a more detailed way in FIGS. 14*a* and 14*b* where particularly visible are the transmission mechanisms relating to the functions of retraction and orientation) comprises, contrary to the solution according to the first embodiment example described above, generally a plurality of motors, i.e. one motor or even a plurality of motors (three motors in the example) for driving the propeller, as well as two other motors used for the function of retraction and the function of orientation of the propeller, respectively. As concerns the motor used to make the boat move forward, it transmits the torque on the large pulley of the transmission shaft with one or more belts. Another difference with respect to the first embodiment, the transmission of torque from the motor for orientation of the propeller is no longer achieved with the aid of two belts, but instead with the aid of a single belt which meshes on a toothed wheel which is held by the fixed casing 1100 of the motorization assembly 1500. The engagement of the motor causes a traction on a belt section and the rotation of the assemblies included in the casing 1100.

As with the first example, each of the motors in the motorization assembly 1500 can be an electric or hydraulic motor.

Figure 10A:
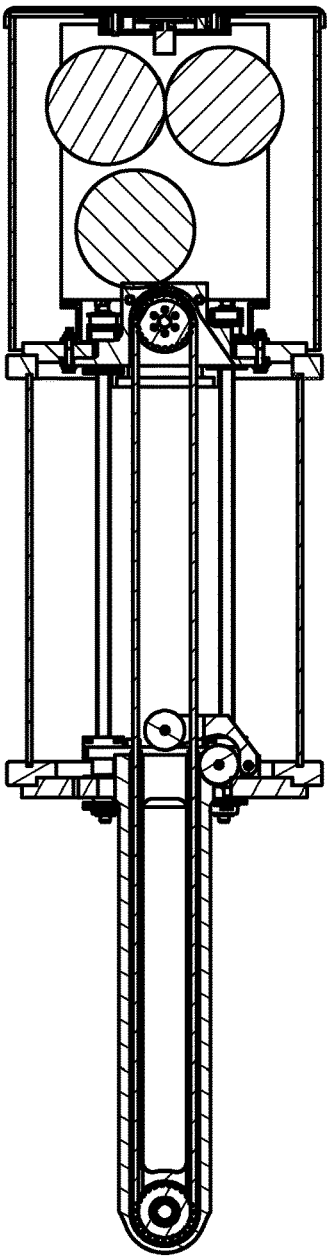
FIG. 10*a* represents the position with the propeller in the operating position.
Figure 10B:
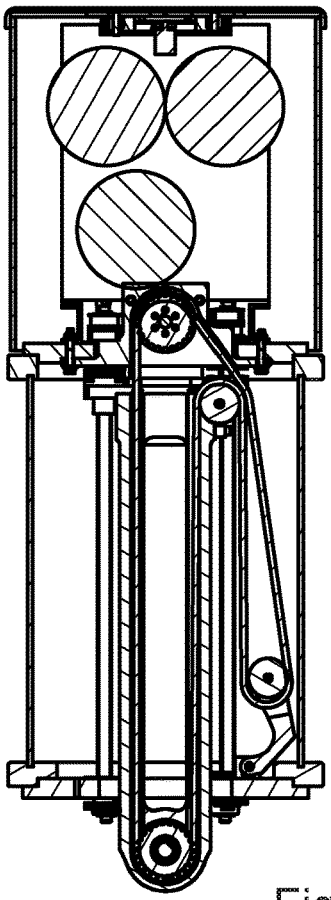
FIG. 10*b* represents the position with the propeller retracted.

As can be seen in FIGS. 10*a* and 10*b*, a mechanism allows the tension of the belt to be maintained during the retraction of the connecting arm with the propeller, and all during its movement. In fact, to this end, the belt is rolled up thanks to a first pulley fixed on the arm (below in FIGS. 10*a* and 10*b*) and a second pulley fixed on the flange of the rotary assembly. It can be seen that a portion of the belt is "diverted" to one side by a corresponding system, comprising a pivotable arm and another pulley.

Figure 11:
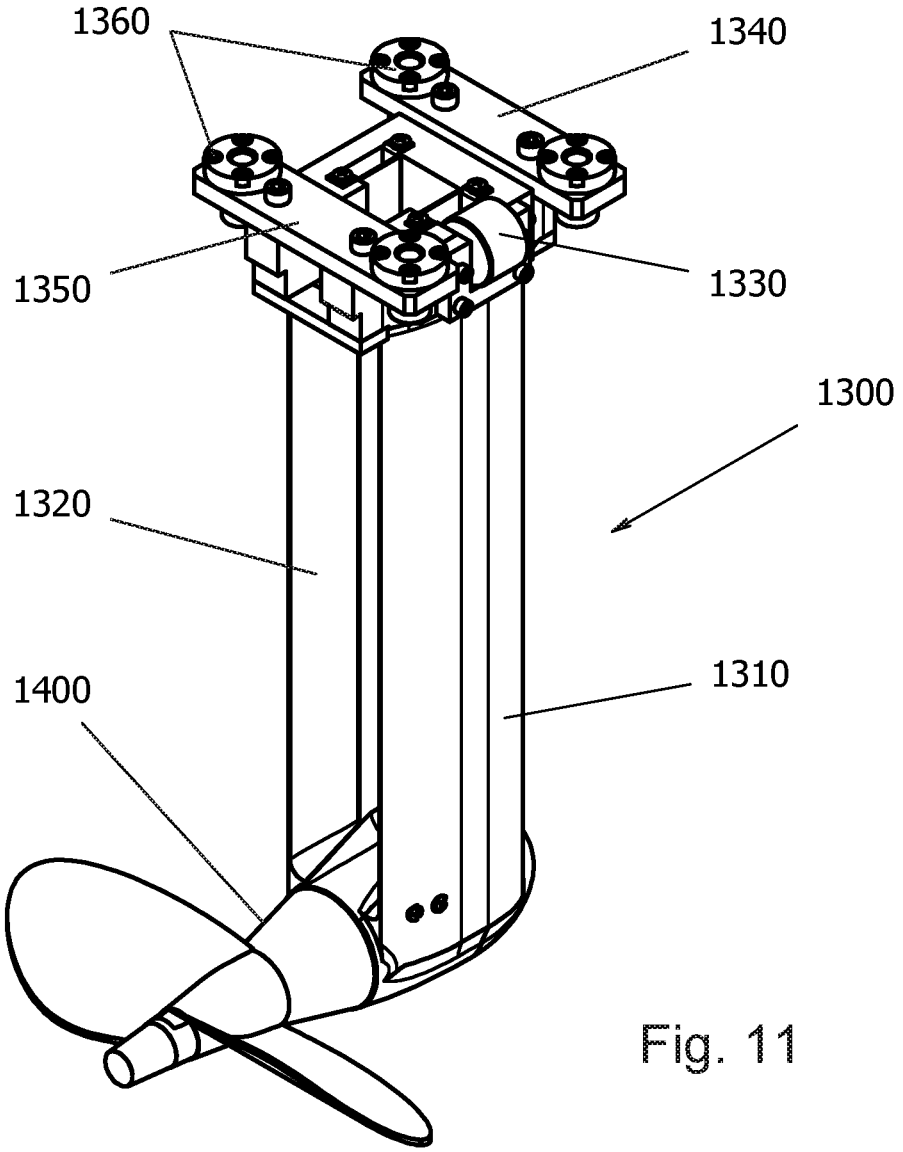
FIG. 11 is a perspective view of the connecting arm of a propulsion system according to FIG. 8.

The connecting arm 1300 with the bulbous part of the propeller 1400 is illustrated in FIG. 11. It comprises two hollow sections 1310 and 1320 accommodating the section of the belt which are fixed above on the movable carriages 1340 and 1350. Visible on the movable carriages 1340 and 1350 are the nuts 1360 which co-operate with the threaded rods of the rotary assembly to achieve the retraction of the connecting arm 1300 and of the propeller. Likewise visible is the pulley 1330 used in the retraction process.

Figure 12:
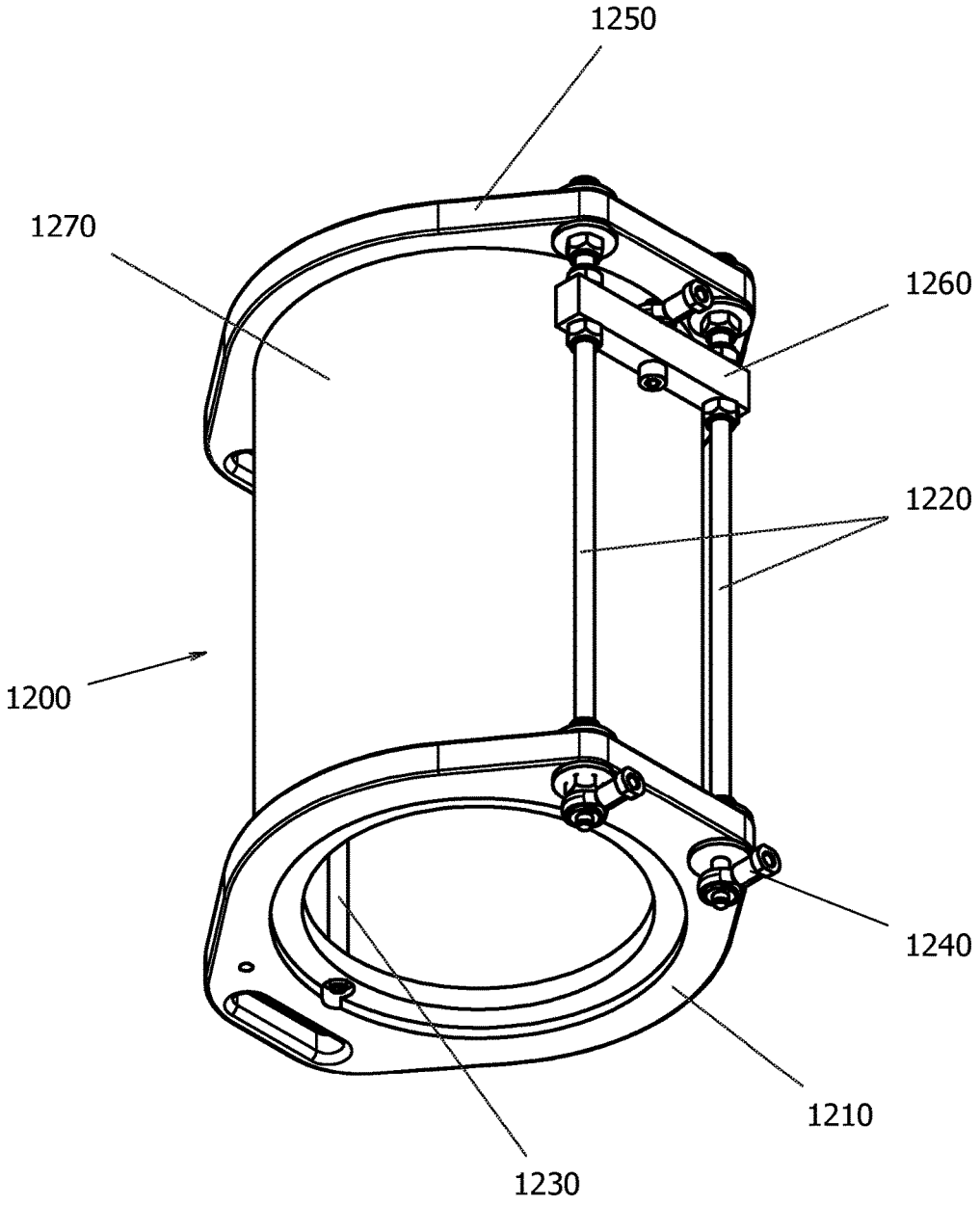
FIG. 12 is a perspective view of the fairing of a propulsion system according to FIG. 8.

FIG. 12 illustrates the fairing 1200 of the propulsion system 1000. It comprises a lower bearing 1210 and an upper bearing 1250 and a cylindrical wall 1270. The lower bearing 1210 and the upper bearing 1250 of the fairing 1200 are fixed in opposition on the cylindrical casing 1270 with the aid of three threaded rods 1220, 1230, two of which (the rods 1220) are used with the fixation element 1260 for fixing the fairing 1200 to the boat.

Figure 13:
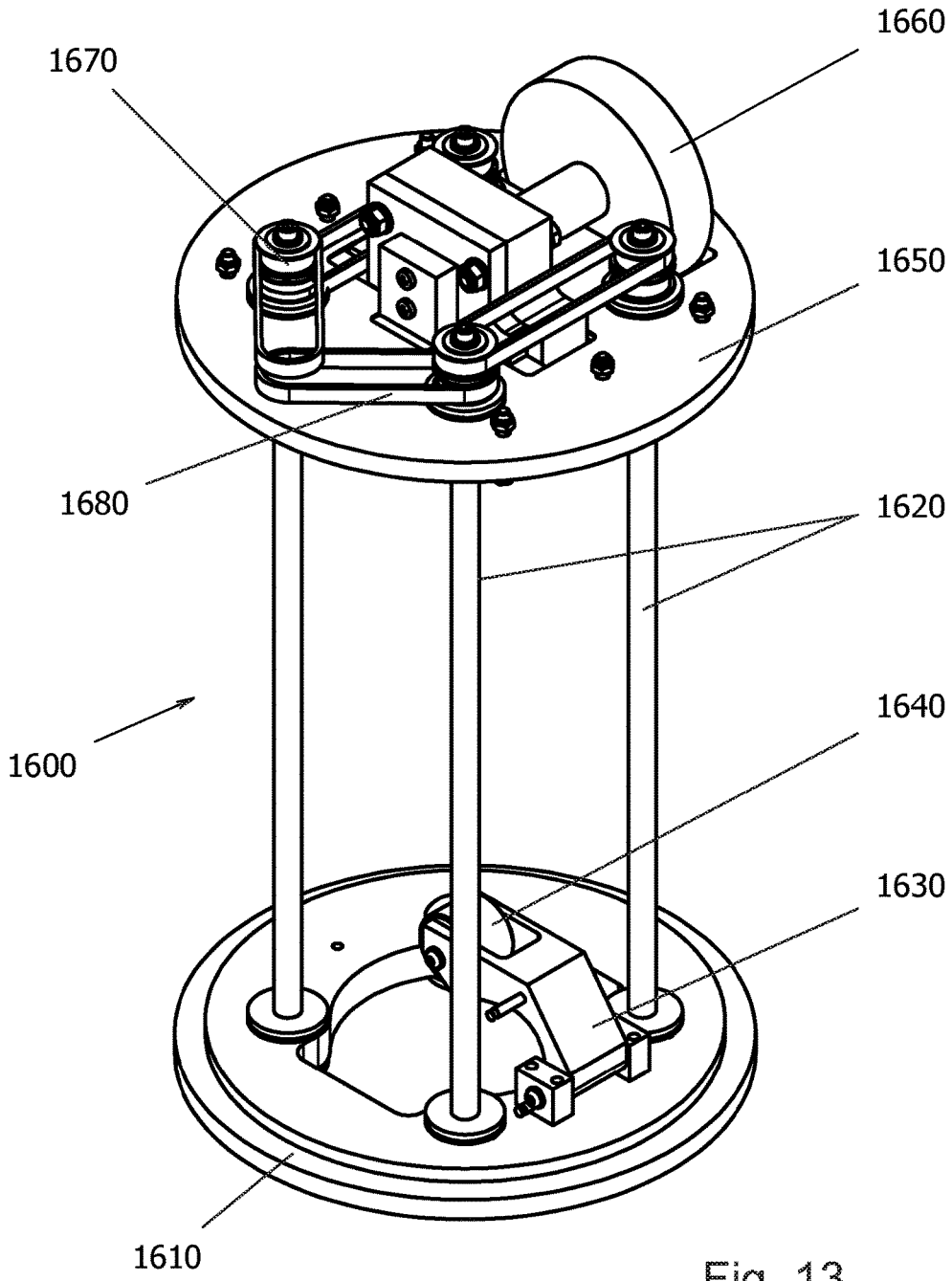
FIG. 13 is a perspective view of the rotary assembly of a propulsion system according to FIG. 8.
Figure 14A:
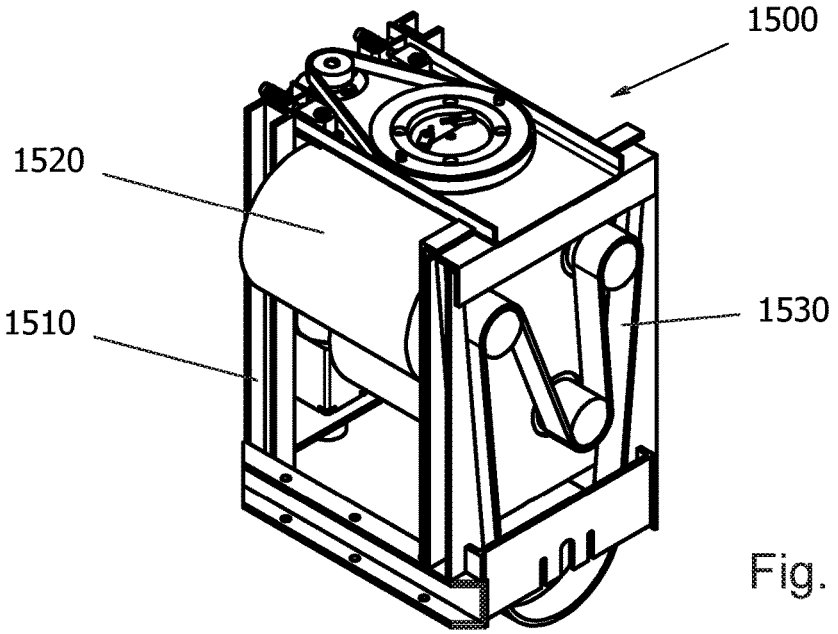
FIG. 14*a* and FIG. 14*b* are perspective views of two different sides of the motorization assembly of a propulsion system according to FIG. 8.
Figure 14B:
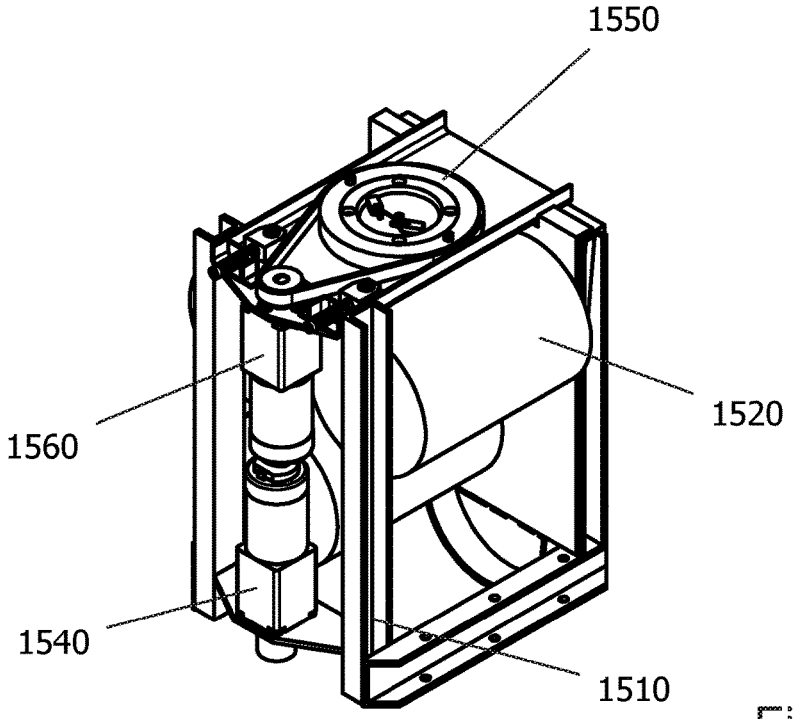

The rotary assembly 1600 used in this second embodiment example is represented in FIG. 13. This rotary assembly 1600 comprises a lower flange 1610 and an upper flange 1650 which are connected to one another by the rods 1620. The pivotable arm 1630 with the pulley 1640 allow the spacing apart of the drive belt, such as represented and mentioned in relation to FIGS. 10*a* and 10*b*. Visible in FIG. 13 is likewise the transmission mechanism of the rotation towards the rods 1620 through the agency of the pulleys 1670 and belts 1680. The orientable guiding system equipped with four threaded rods 1620 with nuts in synchronized rotation with special inserts at their ends makes it possible to transmit great forces, also allowing a movement without risk of jamming.

Contrary to the rotary assembly according to the first embodiment, where only the upper flange prevents the assembly from being displaced vertically, in the rotary assembly according to this second embodiment, it is the two upper 1650 and lower 1610 flanges which maintain the rotary assembly and thereby the removable arm.

Moreover, contrary to the rotary assembly according to the first embodiment example, the transmission shaft is no longer directly connected to the motor. Instead, in place of the motor, this variant provides for a transmission shaft with a large pulley 1660 in order to create with the pulley of the motor a transmission reduction ratio of about 1/3. Thanks to this modification, it is possible to obtain a slower propeller rotation with a greater transmitted torque on the propeller, which makes it possible to use a larger propeller and to thus improve the efficiency of the assembly in a very significant way.

A very large part of the propulsion system according to the second embodiment example can be achieved in composite materials.

The invention claimed is:

1. A propulsion system for a boat, comprising:
- a motor;
- a connecting arm;
- a fairing portion intended for being mounted on the boat;
- at least one propeller;
- a belt for transmitting the torque from said motor to said at least one propeller, said belt forming two belt sections between said motor and said propeller;
- a first rotary assembly with said belt passing therethrough and capable of pivoting relative to said fairing portion about a geometrical axis directed towards the top, so as to orient said at least one propeller relative to the boat in order to turn the latter; and
- a second assembly capable of being translated relative to said first rotary assembly in order to retract said at least one propeller.

2. Propulsion system according to claim 1, wherein said connecting arm comprises two sections set apart from each other, a single belt section passing through each said section.

3. Propulsion system according to claim 2 wherein said two sections of the arm form fins.

4. Propulsion system according to claim 1 wherein said arm is non-impervious.

5. Propulsion system according to claim 1 wherein each said at least one propeller is accommodated in a bulbous part and is mounted on a shaft.

6. Propulsion system according to claim 5, wherein the said at least one propeller is mounted in a removable way on the said shaft.

7. Propulsion system according to claim 1, comprising a first electric motor to make said first rotary assembly pivot.

8. Propulsion system according to claim 7, comprising two belts and in opposition, fixed at their ends to said fairing portion and put under traction by said first electric motor.

9. Propulsion system according to claim 1, wherein said first rotary assembly is able to be pivoted manually.

10. Propulsion system according to claim 1, said first rotary assembly comprising an upper flange and a lower flange connected to each other by rods.

11. Propulsion system according to claim 10, wherein said rods are rotary and threaded.

12. Propulsion system according to claim 11 wherein said rods are fixed to said upper flange and said lower flange by semi-rigid inserts.

13. Propulsion system according to claim 1 wherein said second assembly is able to be translated manually.

14. Propulsion system according to claim 1, comprising a second electric motor to make said second assembly translate.

15. Boat equipped with a propulsion system according to claim 1.

* * * * *